US007083183B2

(12) United States Patent
Spanier et al.

(10) Patent No.: US 7,083,183 B2
(45) Date of Patent: Aug. 1, 2006

(54) SKI

(75) Inventors: Hervé Spanier, Sallanches (FR); Fanny Caspar, Salins-les-Thermes (FR); Claudia Stern, Valbonne (FR); Fabrice Magoni, Voiron (FR); Jean-Paul Alussi, Sallanches (FR); Stéphane Bernard, Sallanches (FR); Marc Rene, Sallanches (FR)

(73) Assignees: Skis Dynastar, Sallanches (FR); Skis Rossignol S.A., Voiron (FR)

( * ) Notice: Subject to any disclaimer, the term of this patent is extended or adjusted under 35 U.S.C. 154(b) by 65 days.

(21) Appl. No.: 11/010,407

(22) Filed: Dec. 14, 2004

(65) Prior Publication Data

US 2005/0140117 A1 Jun. 30, 2005

(30) Foreign Application Priority Data

Dec. 24, 2003 (FR) ..... 03 51197

(51) Int. Cl.
*A63C 5/07* (2006.01)

(52) U.S. Cl. ..... 280/602; 280/607; 280/609

(58) Field of Classification Search ..... 280/601, 280/602, 607, 609

See application file for complete search history.

(56) References Cited

U.S. PATENT DOCUMENTS

| | | | | |
|---|---|---|---|---|
| 4,007,948 | A | 2/1977 | Sarver | |
| 4,085,947 | A | 4/1978 | Sarver | |
| 4,858,945 | A * | 8/1989 | Kashiwa | 280/610 |
| 5,143,395 | A | 9/1992 | Mayr | |
| 5,286,051 | A * | 2/1994 | Scherubl | 280/607 |
| 5,344,176 | A * | 9/1994 | Trimble | 280/602 |
| 5,375,868 | A | 12/1994 | Sarver | |
| 5,435,588 | A * | 7/1995 | Commier et al. | 280/602 |
| 5,575,495 | A * | 11/1996 | Dusser et al. | 280/602 |
| 5,603,522 | A * | 2/1997 | Nelson | 280/609 |
| 5,871,225 | A * | 2/1999 | Sutherland | 280/609 |
| 6,382,658 | B1 * | 5/2002 | Stubblefield | 280/609 |
| 2001/0035630 | A1 | 11/2001 | Cuzzit et al. | |

FOREIGN PATENT DOCUMENTS

| | | |
|---|---|---|
| FR | 2 337 564 | 8/1977 |
| WO | WO 97/28857 | 8/1997 |

* cited by examiner

*Primary Examiner*—Christopher P. Ellis
*Assistant Examiner*—John Walters
(74) *Attorney, Agent, or Firm*—Browdy and Neimark, PLLC

(57) ABSTRACT

A short ski (1) having a length $L_T$ of less than 110 cm, in particular for skiing by children, having a reduced-thickness region (3) in its central zone (2), which is bounded at the front and the rear by maximum-thickness regions (4, 5) each capable of holding the elements (6, 7) of a safety binding, said ski having an overall flexibility ($S_G$), that is to say a flexure under deformation by a force F of 20 decanewtons applied to the upper surface of the ski midway between the two supporting points respectively lying level with the front contact line ($L_{CFR}$) and rear contact line ($L_{CRE}$), which is between:

$$\frac{L_p^3}{H_{\max}^2} \times 10^{-5} \text{ and } \frac{L_p^3}{H_{\max}^2} \times 2.10^{-5}$$

expressed in millimeters, where $L_p$ is the bearing length as defined between the front and rear contact lines and $H_{max}$ is the maximum thickness of the ski, both expressed in millimeters.

5 Claims, 1 Drawing Sheet

SKI

TECHNICAL FIELD

The invention relates to the field of gliding sports, and more particularly alpine skiing. It more precisely concerns a ski architecture more specifically intended for skiing by children. The invention aims to optimize various dimensional parameters of the ski in order to help young children learn to ski, by combining easiness with stability.

PRIOR ART

Generally, of course, the skis used by children are small. The invention relates to the smallest ski sizes, typically with a length of less than 110 centimeters. In view of their light weight and inexperience, children need skis which have great flexibility and good stability. The stability can be obtained by widening the skis in order to make it harder to tilt from one edge to the other.

It will be understood that this widening is undesirable in the case of skis intended for adults, or more generally experienced skiers, who instead wish to make it easier to change from one edge to the other. Good stability will thus be obtained with children's skis which have a maximum central width of 70 millimeters.

Another important parameter for children's skis relates to their flexural stiffness, also referred to as "flexibility".

This is because it is necessary for children's skis to be relatively flexible to make it easier to bend them, that is to say curve the ski in order to perform a turn, which bending generally results from the weight and acceleration.

The thickness of a ski is defined by its structure, that is to say the number and mechanical properties of the internal reinforcements embedded in the ski, and the positioning of these reinforcements relative to the neutral fibre, as well as by the dimensional properties of the board, that is to say the thickness and width of the ski.

For instance, the stiffness is substantially proportional to the width of the upper reinforcement and varies with the square of the distance between this reinforcement and the neutral fibre, substantially corresponding to the medial thickness of the ski.

Consequently, any attempt to widen the board in order to obtain more stability causes an increase in the thickness of the ski, which therefore makes it less manageable for a child.

The solution which consists in reducing the thickness of the ski is limited, since a minimum thickness must be respected in order to make it possible to anchor the elements of the binding. In this regard, ISO standard 8364 requires that skis should have a sufficient thickness to drill holes to a depth of 7.5 millimeters in order to attach the retaining screws of the bindings.

In summary, it is an object of the invention to provide a ski which has increased stability and therefore has a greater width than available skis, while maintaining sufficiently reliable stiffness to make it possible for a child to bend the ski. This compromise must furthermore comply with the minimum thickness conditions dictated by the standardization aspects relating to attachment of the bindings.

DESCRIPTION OF THE INVENTION

The invention therefore relates to a short ski having a length of less than 110 cm, intended in particular for skiing by children.

According to the invention, this ski has a reduced-thickness region in its central zone, which is bounded at the front and the rear by maximum-thickness regions each capable of holding the elements of a safety binding.

In other words, the center of the ski has a hollowed zone lying between the toe-piece and the heel-piece of the binding. This reduced-thickness zone therefore makes it possible to lessen the thickness of the ski at least in its middle part, while remaining compatible with the standardized requirements for attachment of the bindings.

More precisely, the thickness of the ski is characterized by an overall flexibility which is much greater than that encountered with the children's skis manufactured to date. The overall flexibility is therefore defined in a standardized way as being the flexure under deformation by a force of 20 decanewtons applied to the upper surface of the ski, midway between two supporting points respectively lying level with the front and rear contact lines.

According to the invention this overall flexibility, expressed in millimeters, is between $$\frac{L_p^3}{H_{\max}^2} \times 10^{-5} \text{ and } \frac{L_p^3}{H_{\max}^2} \times 2.10^{-5}$$

where $L_p$ is the bearing length as defined between the front and rear contact lines and $H_{max}$ is the maximum thickness of the ski, both expressed in millimeters.

In practice, the stiffness is found to be sufficient when the difference in thickness between the characteristic reduced-thickness region and the maximum thickness $H_{max}$ is between 1 and 5 millimeters, and preferably close to 1.5 millimeters.

It will be noted that the maximum thickness of the ski should be interpreted in structural terms, that is to say considering the thickness of the zones which have a predominant influence on the overall stiffness of the ski.

In other words, this maximum thickness is calculated while ignoring any protrusions or projecting zones which have an essentially aesthetic purpose and do not have any great effect on the stiffness of the ski.

Thus, in practice, the maximum thickness of the ski ($H_{max}$) is advantageously between 10 and 14 millimeters, and is preferably close to 11 millimeters.

In practice, the dimensions of the characteristic hollowed zone are such that this reduced-thickness region extends over a length of between 80 and 200 millimeters.

The length of the zone is measured by the distance between the points of greatest thickness lying directly in front of and behind the hollowed zone. In the event that the maximum thickness remains constant over a fraction of the length of the ski, the maximum-thickness point lying closest to the hollow will be considered.

In this way, the ski can be substantially widened in the central zone compared with an existing ski, so as to give the center a width advantageously lying between 73 and 80 millimeters.

BRIEF DESCRIPTION OF THE FIGURES

The way in which the invention is embodied, as well as the advantages that result therefrom, will become readily apparent from the following description of the embodiment with reference to the appended figures, in which.

EMBODIMENT OF THE INVENTION

As already mentioned, the invention relates to skis which are intended to be used by children, and which therefore have a short total length $L_t$ of less than 110 centimeters.

Figure 1:
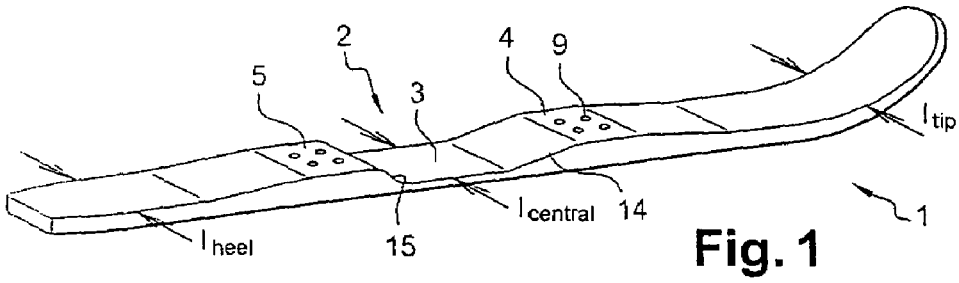
FIG. 1 is a simplified perspective view of a ski according to the invention.

As illustrated in FIG. 1, such a ski (1) has a reduced-thickness hallowed region (3) in its central zone (2), which is bounded by thicker zones (4, 5) at the front and the rear. These zones (4, 5) are designed to hold the toe-piece (6) and the heel-piece (7) of the binding, by means of screws (8) fitted into holes (9) drilled for this purpose.

Figure 2:
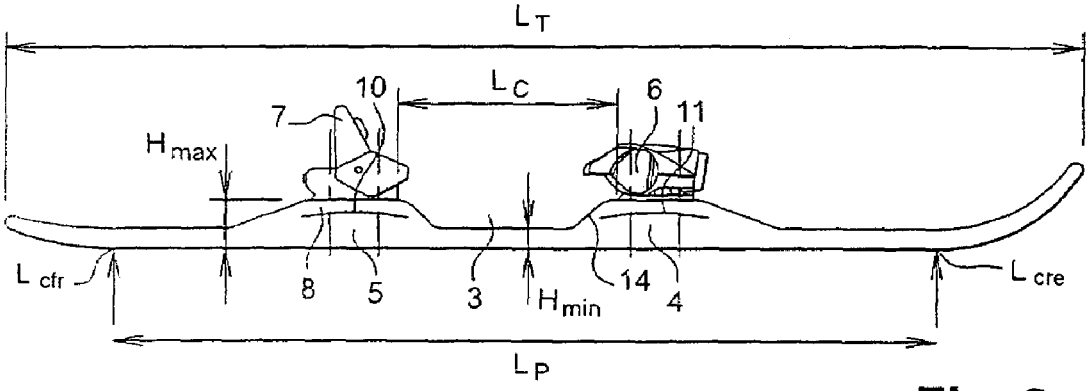
FIG. 2 is a side view of the ski in FIG. 1.

More precisely, and as illustrated in FIG. 2, the thicker zones (4, 5) have a thickness $H_{max}$ which lies between 10 and 14 millimeters, and which is preferably close to 11 millimeters.

The maximum-thickness zone may extend over a certain fraction of the length of the ski, and in particular in the region which receives the elements of the binding.

In their internal structure, these maximum-thickness zones (4, 5) may include reinforcements (10, 11) through which the mounting screws (8) of the binding are intended to pass in order to improve their anchoring.

The region (3) lying between the two elements (6, 7) of the binding has a reduced thickness, the value $H_{min}$ of which is less by from 1 to 5 millimeters, and preferably by 1.5 millimeters, than the maximum thickness value $H_{max}$. The length $L_C$ of the hollowed zone (3) is defined between the foremost maximum-thickness point of the rear zone (5) and the rearmost maximum-thickness point of the front zone (4).

The sloped interruptions (14, 15) between the characteristic hollowed zone (3) and the thicker zones (4, 5) may vary depending on the reinforcements included in the structure of the ski and the constraints of manufacture, especially by molding.

Figure 3:
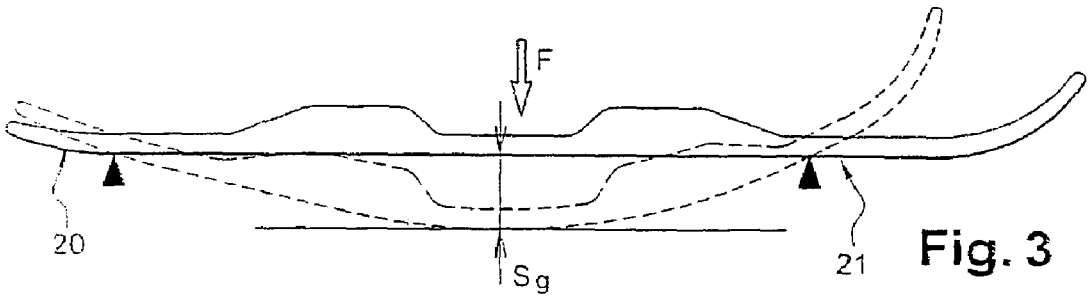
FIG. 3 is a side view showing the conditions for measuring the overall flexibility of the ski.

As illustrated in FIG. 3, the ski (1) has an overall stability which lies in a specific interval, corresponding to skis which are much more flexible than the skis available in equivalent ranges, but while having a width $l_{central}$ at the center which is greater, typically lying between 73 and 85 millimeters.

More precisely, this flexibility $S_g$ is measured in a standardized way by placing the ski on two supporting points (20, 21) arranged level with the front and rear contact lines $L_{CFR}$ and $L_{CRE}$. The distance between these two front and rear contact lines is defined as being the bearing length $L_p$. Midway between these two points (20, 21), the ski receives a vertical force F which is standardized to 20 decanewtons for children's skis. The flexibility $S_g$ is defined as being the vertical displacement of the point where the force F is exerted. According to the invention, this flexibility $S_g$ is between $$\frac{L_p^3}{H_{\max}^2} \times 10^{-5} \text{ and } \frac{L_p^3}{H_{\max}^2} \times 2.10^{-5},$$

in which the length and thickness are measured in millimeters.

In one particular exemplary embodiment corresponding to a ski with a total length of 930 millimeters, having a bearing length ($L_p$) of 765 millimeters and a maximum thickness $H_{max}$ of 11 millimeters, a flexibility of the order of 42 millimeters is therefore obtained.

This flexibility should be compared with the values of about 20 millimeters which correspond to those measured on existing skis.

By virtue of the characteristic hollowed zone, it is possible to widen the ski in order to increase its stability. As illustrated in FIG. 1, for instance, a heel width $l_{heel}$ of 83 millimeters, a width $l_{central}$ of 75 millimeters and a width $l_{tip}$ of 95 millimeters may be defined.

The above description shows that the ski according to the invention has the advantage of being both much more stable and flexible than available skis, while being compliant with the standardization requirements.

The invention claimed is:

1. A short ski (1) having a length $L_T$ of less than 110 cm, intended in particular for skiing by children, having a reduced-thickness region (3) in its central zone (2), which is bounded at the front and the rear by maximum-thickness regions (4, 5) each capable of holding the elements (6, 7) of a safety binding, said ski having an overall flexibility ($S_G$), that is to say a flexure under deformation by a force F of 20 decanewtons applied to the upper surface of the ski midway between two supporting points respectively lying level with the front contact line ($L_{CFR}$) and rear contact line ($L_{CRE}$), which is between:

$$\frac{L_p^3}{H_{\max}^2} \times 10^{-5} \text{ and } \frac{L_p^3}{H_{\max}^2} \times 2.10^{-5}$$

expressed in millimeters, where $L_p$ is the bearing length as defined between the front and rear contact lines and $H_{max}$ is the maximum thickness of the ski, both expressed in millimeters.

2. The ski as claimed in claim 1, wherein the difference between the thickness $H_{min}$ of the reduced-thickness region and $H_{max}$ is between 1 and 5 millimeters, and preferably close to 1.5 millimeters.

3. The ski as claimed in claim 1, wherein $H_{max}$ is between 10 and 14, preferably close to 11 millimeters.

4. The ski as claimed in claim 1, wherein the reduced-thickness region (3) extends over a length $L_C$ of between 80 and 200 millimeters.

5. The ski as claimed in claim 1, wherein the maximum width ($l_{central}$) at the center of the ski is between 73 and 85 millimeters.

* * * * *